US009895922B2

(12) United States Patent
To

(10) Patent No.: US 9,895,922 B2
(45) Date of Patent: Feb. 20, 2018

(54) RING BINDER WITH INTERLOCKING RING MEMBERS

(71) Applicant: World Wide Stationery Mfg. Co., Ltd., Kwai Chung, New Territory (CN)

(72) Inventor: Chun Yuen To, N.T. Hong Kong (CN)

(73) Assignee: World Wide Stationery Mfg. Co., Ltd., Kwai Chung, New Territories (HK)

( * ) Notice: Subject to any disclaimer, the term of this patent is extended or adjusted under 35 U.S.C. 154(b) by 57 days.

(21) Appl. No.: 15/009,457

(22) Filed: Jan. 28, 2016

(65) Prior Publication Data

US 2016/0229216 A1 Aug. 11, 2016

(30) Foreign Application Priority Data

Feb. 5, 2015 (CN) ..... 2015 1 0063445

(51) Int. Cl.

| | |
|---|---|
| ***B42F 13/26*** | (2006.01) |
| ***B42F 13/16*** | (2006.01) |
| ***B42D 5/00*** | (2006.01) |
| ***B42F 13/40*** | (2006.01) |

(52) U.S. Cl.

CPC ..... *B42F 13/26* (2013.01); *B42D 5/006* (2013.01); *B42F 13/165* (2013.01); *B42F 13/40* (2013.01); *B42P 2241/16* (2013.01)

(58) Field of Classification Search

CPC ..... B42F 13/165; B42F 13/26
USPC ..... 402/19–20, 36–37, 39
See application file for complete search history.

(56) References Cited

U.S. PATENT DOCUMENTS

| | | | |
|---|---|---|---|
| 470,050 | A | 3/1892 | Jewell |
| 683,019 | A | 9/1901 | Buchanan |
| 692,584 | A | 2/1902 | Adams et al. |
| 724,849 | A | 4/1903 | Gresham |
| 763,176 | A | 6/1904 | Gresham et al. |
| 778,992 | A | 1/1905 | Nelson |
| 792,389 | A | 6/1905 | Boehner |
| 812,397 | A | 2/1906 | Boehner |
| 840,949 | A | 1/1907 | Mendenhall |
| 842,851 | A | 2/1907 | Boden |

(Continued)

FOREIGN PATENT DOCUMENTS

| | | | |
|---|---|---|---|
| BE | 867999 | A1 | 12/1978 |
| CN | 1084809 | A | 4/1994 |

(Continued)

*Primary Examiner* — Kyle Grabowski
(74) *Attorney, Agent, or Firm* — Senniger Powers LLP

(57) ABSTRACT

A ring binder for use in holding loose-leaf pages. A retaining system is configured to selectively and releasably hold first and second ring members in a closed position. First and second interlocking formations are selectively movable relative to one another between a retaining position and a non-retaining position. The first interlocking formation includes a projection having a free end. The free end has a void configured and arranged to permit resilient bending of portions of the free end of the projection in a first direction as they engage the second interlocking formation when the interlocking formations are moved from the non-retaining position to the retaining position. In the retaining position, the portions of the free end of the projection are substantially inhibited from bending in a second direction in response to pivoting movement of either of the ring members.

14 Claims, 16 Drawing Sheets

(56) References Cited

U.S. PATENT DOCUMENTS 857,377 A 6/1907 Baker
901,076 A 10/1908 Dawson
904,618 A 11/1908 Kellner, Jr.
936,448 A 10/1909 Hamacher
959,182 A 5/1910 Trussell
968,657 A 8/1910 Hamacher et al.
974,831 A 11/1910 Scherzinger
1,020,561 A 3/1912 Krumming
1,025,170 A 5/1912 Trussell
1,105,196 A 7/1914 Hanke
1,163,179 A 12/1915 Schade, Jr.
1,165,766 A 12/1915 Elder
1,231,816 A 7/1917 Vesterling
1,331,226 A 2/1920 Adams
1,398,034 A 11/1921 Mero
1,398,388 A 11/1921 Murphy
1,398,540 A 11/1921 Day
1,402,018 A 1/1922 Schade
1,473,354 A 11/1923 Nachtrieb
1,548,748 A 8/1925 Riley
1,610,985 A 12/1926 Vea
1,733,548 A 10/1929 Martin
1,733,894 A 10/1929 Martin
1,765,353 A 6/1930 Myers
1,787,957 A 1/1931 Schade
1,797,447 A 3/1931 Savidge
1,816,021 A 7/1931 Meyerson
1,919,784 A 7/1933 Frieberg
1,932,874 A 10/1933 Adams et al.
1,991,362 A 2/1935 Krag
1,996,463 A 4/1935 Dawson et al.
2,013,416 A 9/1935 McClure
2,020,129 A 11/1935 Wedge
2,024,461 A 12/1935 Lotter
2,030,473 A 2/1936 Schade
2,075,766 A 3/1937 Rand
2,077,677 A 4/1937 Dawson et al.
2,088,431 A 7/1937 Newman
2,089,211 A 8/1937 Krag
2,096,944 A 10/1937 Unger et al.
2,104,046 A 1/1938 Krag
2,105,235 A 1/1938 Schade
2,119,639 A 6/1938 Lotter
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,121 A 4/1941 St. Louis et al.
2,252,422 A 8/1941 Unger
2,260,929 A 10/1941 Bloore
2,268,431 A 12/1941 Slonneger
2,288,189 A 6/1942 Guinane
2,304,716 A 12/1942 Supin
2,311,492 A 2/1943 Unger
2,311,620 A 2/1943 Murphy
2,322,595 A 6/1943 Schade
2,363,848 A 11/1944 Emmer
2,389,115 A 11/1945 Anderson
2,421,799 A 6/1947 Martin
2,460,718 A 2/1949 Stevens
2,528,866 A 11/1950 Dawson, Jr.
2,543,866 A 3/1951 Panfil, Sr.
2,548,618 A 4/1951 Purvis
2,612,169 A 9/1952 Segal
2,645,227 A 7/1953 Segal
2,664,897 A 1/1954 Derringer
2,711,555 A 6/1955 Hanson
2,715,906 A 8/1955 Lucchesi
2,865,377 A 12/1958 Schroer et al.
2,871,711 A 2/1959 Stark
2,891,553 A 6/1959 Acton
3,077,888 A 2/1963 Thieme
3,098,489 A 7/1963 Vernon
3,098,490 A 7/1963 Wance
3,104,667 A 9/1963 Mintz
3,105,494 A 10/1963 Duncan
3,135,266 A 6/1964 Bouhier
3,149,636 A 9/1964 Rankin
3,153,417 A 10/1964 Newman
3,190,293 A 6/1965 Schneider et al.
3,205,894 A 9/1965 Rankin
3,205,895 A 9/1965 Johnson
3,246,653 A 4/1966 Sexton
3,251,364 A 5/1966 Goldman
3,253,842 A 5/1966 Rabe
3,255,759 A 6/1966 Dennis
3,270,749 A 9/1966 O'Connell
3,275,005 A 9/1966 Cott
3,313,304 A 4/1967 Beyer
3,331,373 A 7/1967 Lohmeier
3,348,550 A 10/1967 Wolf et al.
3,718,402 A 2/1973 Schade
3,728,036 A 4/1973 Cott
3,748,051 A 7/1973 Frank
3,827,111 A 8/1974 O'Connell
3,833,308 A 9/1974 Seaborn
3,884,586 A 5/1975 Michaelis et al.
3,954,343 A 5/1976 Thomsen
3,993,374 A 11/1976 Schudy et al.
3,995,961 A 12/1976 Dorfman et al.
4,127,340 A 11/1978 Almgren
4,130,368 A 12/1978 Jacoby et al.
4,308,637 A 1/1982 Kucera
4,352,582 A 10/1982 Eliasson
4,415,290 A 11/1983 Ohminato
4,486,112 A 12/1984 Cummins
4,522,526 A 6/1985 Lozfau et al.
4,551,118 A 11/1985 Spisz
4,566,817 A 1/1986 Barrett, Jr.
4,571,108 A 2/1986 Vogl
4,577,985 A 3/1986 Beyer
4,607,970 A 8/1986 Heusinkveld
4,624,595 A 11/1986 Ohminato
4,678,357 A 7/1987 Kissel et al.
4,690,580 A 9/1987 Kissel
4,693,624 A 9/1987 Moosmuller
4,696,595 A 9/1987 Pinkney
4,798,491 A 1/1989 Lassle
4,813,803 A 3/1989 Gross
4,815,882 A 3/1989 Ohminato
4,886,390 A 12/1989 Silence et al.
4,904,103 A 2/1990 Im
4,919,557 A 4/1990 Podosek
D317,177 S 5/1991 Wandemberg-Boschetti
5,018,896 A 5/1991 Vanni
5,116,157 A 5/1992 Gillum et al.
5,180,247 A 1/1993 Yu
5,201,101 A 4/1993 Rouser et al.
5,255,991 A 10/1993 Sparkes
5,286,128 A 2/1994 Gillum
5,354,142 A 10/1994 Yu
5,367,742 A 11/1994 Bindman
5,368,407 A 11/1994 Law
5,392,848 A 2/1995 Bottcher et al.
5,393,156 A 2/1995 Mullin et al.
5,476,335 A 12/1995 Whaley
5,618,122 A 4/1997 Constantine
5,642,954 A 7/1997 Hudspith
5,660,490 A 8/1997 Warrington
5,692,847 A 12/1997 Zane et al.
5,692,848 A 12/1997 Wada
5,697,722 A 12/1997 Hladik et al.
5,718,529 A 2/1998 Chan
5,765,956 A 6/1998 Lanzarin
5,782,569 A 7/1998 Mullin et al.
5,807,006 A 9/1998 Cheung
5,810,499 A 9/1998 Law
5,816,729 A 10/1998 Whaley
5,827,004 A 10/1998 Kim
5,868,513 A 2/1999 Law
5,895,164 A 4/1999 Wu
5,938,365 A 8/1999 Grewe et al.
5,975,784 A 11/1999 Whaley

(56) References Cited

U.S. PATENT DOCUMENTS

| | | | |
|---|---|---|---|
| 5,975,785 | A | 11/1999 | Chan |
| 6,036,394 | A | 3/2000 | Cheng |
| D430,204 | S | 8/2000 | Berracasa |
| 6,109,813 | A | 8/2000 | To et al. |
| 6,155,737 | A | 12/2000 | Whaley |
| 6,179,507 | B1 | 1/2001 | Lam |
| 6,179,508 | B1 | 1/2001 | Coerver |
| 6,203,229 | B1 | 3/2001 | Coerver |
| 6,206,601 | B1 | 3/2001 | Ko |
| 6,217,247 | B1 | 4/2001 | Ng |
| 6,270,279 | B1 | 8/2001 | Whaley |
| 6,270,280 | B1 | 8/2001 | Baumann |
| 6,276,862 | B1 | 8/2001 | Snyder et al. |
| 6,293,722 | B1 | 9/2001 | Holbrook et al. |
| 6,328,497 | B1 | 12/2001 | To |
| 6,364,558 | B1 | 4/2002 | To |
| 6,467,984 | B1 | 10/2002 | To |
| 6,514,000 | B2 | 2/2003 | Youngs et al. |
| 6,749,357 | B2 | 6/2004 | Cheng |
| 6,761,497 | B2 | 7/2004 | Kaneda |
| 6,840,695 | B2 | 1/2005 | Horn |
| D533,588 | S | 12/2006 | Cheng |
| 7,223,040 | B2 | 5/2007 | Koike et al. |
| 7,275,886 | B2 | 10/2007 | Cheng |
| 7,293,932 | B2 | 11/2007 | Wong |
| 7,296,946 | B2 | 11/2007 | Cheng et al. |
| 7,360,962 | B2 | 4/2008 | To |
| 7,478,963 | B2 | 1/2009 | Tanaka et al. |
| 7,549,817 | B2 | 6/2009 | Cheng et al. |
| 7,600,939 | B2 | 10/2009 | Liu et al. |
| 8,002,488 | B2 | 8/2011 | Cheng |
| 2003/0044221 | A1 | 3/2003 | To et al. |
| 2003/0103798 | A1 | 6/2003 | Cheng et al. |
| 2003/0123923 | A1 | 7/2003 | Koike et al. |
| 2004/0086323 | A1 | 5/2004 | Taneka et al. |
| 2005/0013654 | A1 | 1/2005 | Cheng et al. |
| 2005/0201818 | A1 | 9/2005 | Cheng |
| 2005/0207826 | A1 | 9/2005 | Cheng et al. |
| 2005/0271459 | A1 | 12/2005 | To et al. |
| 2006/0024124 | A1 | 2/2006 | Cheng |
| 2006/0153628 | A1 | 7/2006 | Tanaka et al. |
| 2006/0153630 | A1 | 7/2006 | Cheng |
| 2008/0080925 | A1 | 4/2008 | Cheng |
| 2008/0080926 | A1 | 4/2008 | Liu et al. |
| 2009/0110470 | A1 | 4/2009 | To et al. |
| 2010/0003070 | A1 | 1/2010 | Cheng |
| 2010/0150642 | A1 | 6/2010 | Lee |
| 2011/0305500 | A1* | 12/2011 | To ..... B42F 13/26 402/36 |

FOREIGN PATENT DOCUMENTS

| | | | |
|---|---|---|---|
| CN | 2254407 | Y | 5/1997 |
| CN | 2740416 | Y | 11/2005 |
| CN | 2790771 | Y | 6/2006 |
| CN | 201613729 | U | 10/2010 |
| CN | 202071539 | U | 12/2011 |
| DE | 2540340 | A1 | 4/1977 |
| EP | 1681157 | A2 | 7/2006 |
| EP | 2002990 | A1 | 12/2008 |
| FR | 1336765 | A | 9/1963 |
| FR | 1346864 | A | 12/1963 |
| FR | 2221924 | A5 | 10/1974 |
| FR | 2238332 | A5 | 2/1975 |
| GB | 868724 | A | 5/1961 |
| GB | 906279 | A | 9/1962 |
| GB | 952536 | A | 3/1964 |
| GB | 1101760 | A | 1/1968 |
| GB | 1452738 | A | 10/1976 |
| GB | 2292343 | A | 2/1996 |
| GB | 2387815 | A | 10/2003 |
| JP | 5979379 | U | 5/1984 |
| JP | 6118880 | U | 2/1986 |
| JP | 1299095 | A | 12/1989 |
| JP | 2034289 | U | 3/1990 |
| JP | 4120085 | U | 10/1992 |
| JP | 3042732 | U | 10/1997 |
| JP | 2007050684 | A | 3/2007 |
| WO | 0018585 | A2 | 4/2000 |
| WO | 0074950 | A1 | 12/2000 |
| WO | 2005035265 | A1 | 4/2005 |
| WO | 2011153950 | A1 | 12/2011 |

* cited by examiner

RING BINDER WITH INTERLOCKING RING MEMBERS

CROSS REFERENCE TO RELATED APPLICATION

This application claims priority to Chinese Patent Application No. 201510063445.9, filed Feb. 5, 2015, the entire contents of which are incorporated by reference.

FIELD OF THE INVENTION

Aspects of the present invention generally relate to a ring binder mechanism for retaining loose-leaf pages. More particularly, aspects of the present invention relate to a ring binder mechanism with ring members having interlocking formations for securing the ring members in a closed position.

BACKGROUND OF THE INVENTION

Ring binder mechanisms having rings for selectively retaining loose-leaf pages are well known. These mechanisms are commonly fastened to other structures such as notebook covers, files, clipboards, and the like to enable the rings to retain loose-leaf pages. The rings of ring binder mechanisms typically include two ring members that are selectively movable between an open position for receiving loose-leaf pages and a closed position for retaining loose-leaf pages. Conventionally, the ring members are hingedly connected to a base for pivoting movement relative the base. When the ring binder mechanism retains loose-leaf pages in the closed position, it is preferable for the rings to remain secured in the closed position. For certain types of ring binder mechanisms, when the rings are in the closed position, the rings are biased by a spring force towards the closed position to prevent unintended opening of the rings. The ring members of these and other types of ring binder mechanisms can also include interlocking formations that secure the ring in the closed position. However, known interlocking formations can be prone to disengagement in response to forces urging the ring members to pivot toward their open position. For example, if a ring binder loaded with paper is dropped, the ring members can be subject to lateral forces in the same direction as the ring member naturally opens. Some interlocking formations may be inadequate to resist such forces.

SUMMARY OF THE INVENTION

In one aspect, a ring binder for use in holding loose-leaf pages comprises an elongate base. Rings for retaining loose leaf pages include first and second ring members movable relative to one another between a closed position in which the first and second ring members together form a substantially continuous closed loop and an open position in which the first and second ring members form a discontinuous open loop. At least one of the first and second ring members are hingedly connected to the elongate base for selective pivoting movement toward the open and closed positions. A retaining system is configured to selectively and releasably hold the first and second ring members in the closed position. The retaining system comprises first and second interlocking formations adjacent ends of the first and second ring members, respectively. The first and second interlocking formations are selectively movable relative to one another between a retaining position in which the retaining system holds the first and second ring members in the closed position and a non-retaining position in which the retaining system does not hold the first and second ring members in the closed position. The first interlocking formation comprises a projection having a free end. The free end has a void configured and arranged to permit resilient bending of portions of the free end of the projection in a first direction as they engage the second interlocking formation when the interlocking formations are moved from the non-retaining position to the retaining position. Said portions of the free end of the projection are arranged relative the void so that in the retaining position said portions are substantially inhibited from bending in a second direction in response to the pivoting movement of said at least one of the ring members.

In another aspect, a ring binder for use in holding loose-leaf pages comprises an elongate base having a length and opposite longitudinal sides and rings for retaining loose leaf pages. Each ring includes first and second ring members movable between a closed position in which the first and second ring members form a continuous closed loop and an open position in which the first and second ring members form a discontinuous open loop. Each ring member includes a proximal end connected to the base and an opposite distal end. The first ring member comprises a first interlocking portion adjacent the distal end thereof and the second ring member comprises a second interlocking portion adjacent the distal end thereof. The first interlocking portion comprises a first interlocking formation, and the second interlocking portion comprises a second interlocking formation. The interlocking formations are configured to selectively and releasably engage one another for holding the ring members in the closed position. The interlocking formations are selectively movable relative to one another between a retaining position in which the interlocking formations engage one another to hold the first and second ring members in the closed position and a non-retaining position in which the interlocking formations do not engage one another to hold the first and second ring members in the closed position. The first interlocking formation comprises a projection extending along an axis generally lengthwise of the elongate base and having a free end. The free end of the projection comprises a single elongate slot having opposite sides and extending transverse to the axis of the projection and between the opposite longitudinal sides of the elongate base in the retaining position. The projection comprises a finger adjacent each of the opposite sides of the elongate slot. The fingers are adapted to engage the second interlocking formation and resiliently bend inward toward the slot as the interlocking formations are moved from the non-retaining position to the retaining position and configured to resist bending in a transverse direction between the opposite longitudinal sides of the elongate base in the retaining position.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
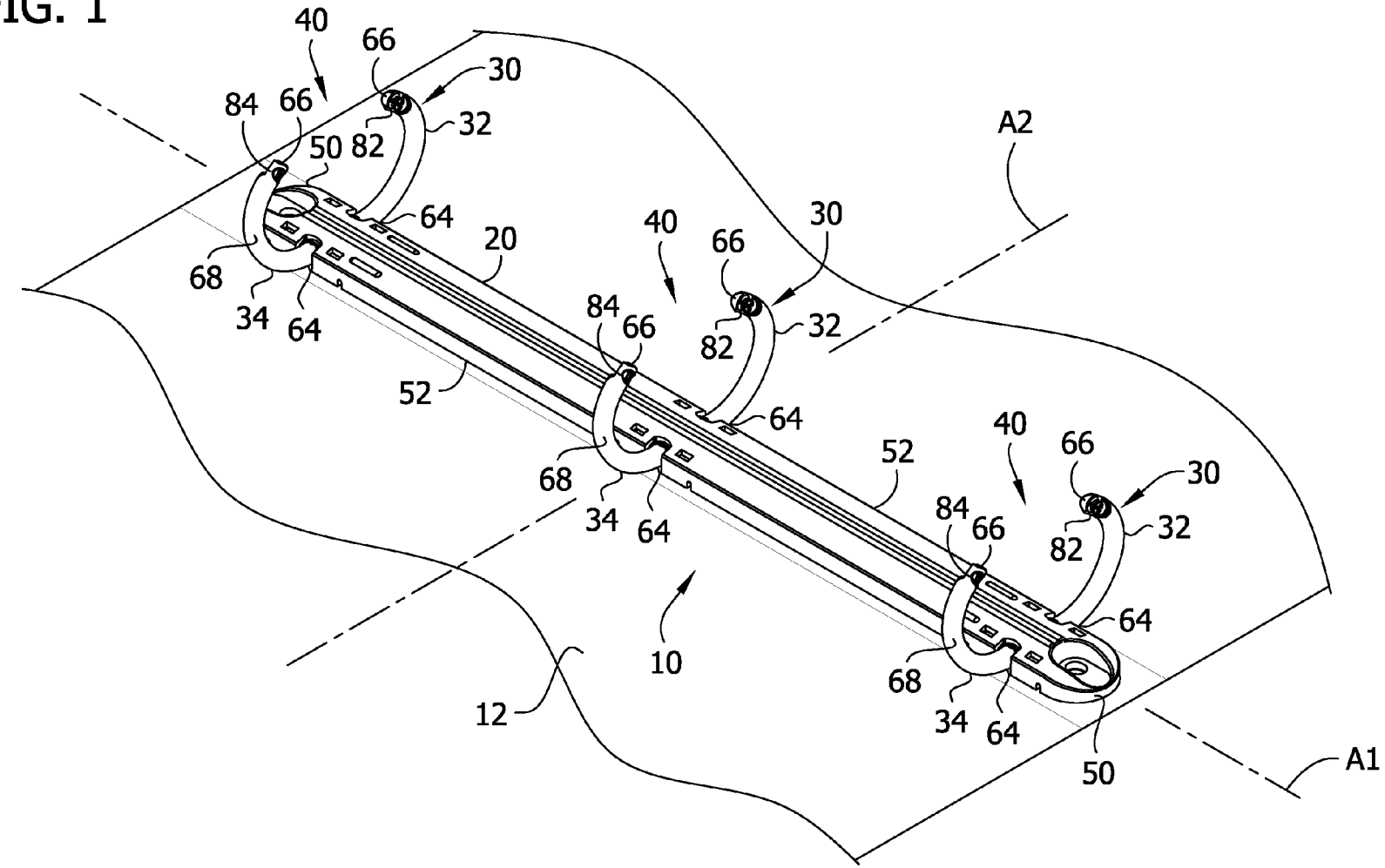
FIG. 1 is a top side perspective of a ring binder mechanism in an open position attached to the spine of a three-ring notebook.
Figure 2:
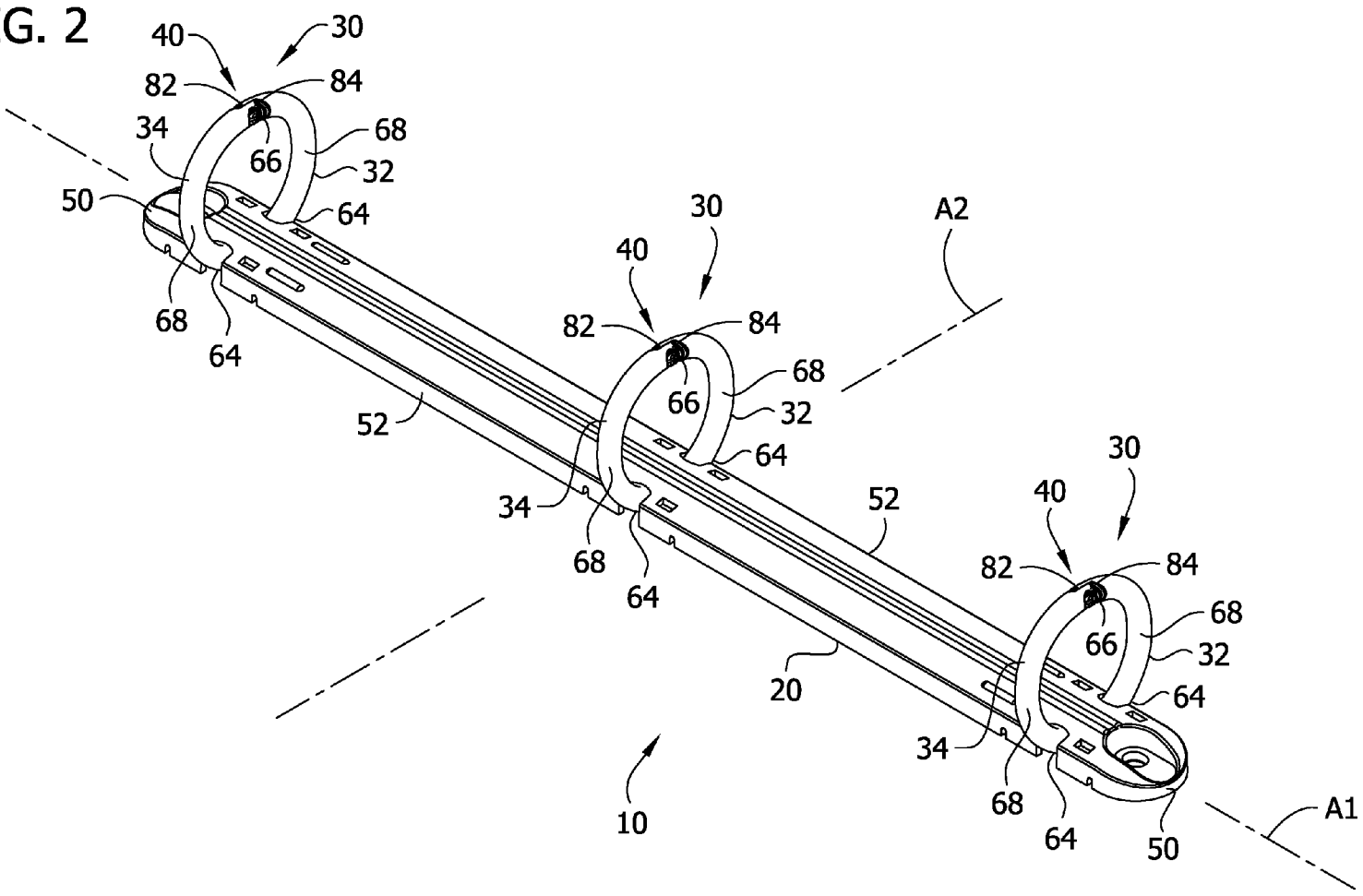
FIG. 2 is a top side perspective of the ring binder mechanism in a closed position.

Referring to FIGS. 1 and 2, a ring binder mechanism is generally indicated at reference number 10. In the illustrated embodiment, the ring binder mechanism 10 is configured for attachment to the spine of a three-ring notebook 12. The ring binder mechanism 10 generally includes an elongate base 20. Three rings generally indicated at reference 30, each comprising first and second ring members 32, 34, are hingedly connected to the base 20 for pivoting movement relative thereto. For each of the rings 30, the ring members 32, 34 are selectively movable between an open position (FIG. 1) and a closed position (FIG. 2). In the open position illustrated in FIG. 1, the first and second ring members 32, 34 form a discontinuous, open loop for adding loose-leaf pages to or removing loose-leaf pages from the rings 30. In the closed position illustrated in FIG. 2, the first and second ring members 32, 34 together form a substantially continuous, closed loop for allowing loose-leaf pages retained by the ring 30 to be moved along the ring from one ring member to the other. As will be discussed in greater detail below, each ring 30 includes a retaining system, generally indicated at reference number 40, for securing the ring in the closed position. The illustrated retaining system 40 provides interlocking engagement that resists the pivoting movement of the ring members 32, 34 relative the base 20 away from the closed position. The number of rings and ring members may be other than shown.

Figure 3:
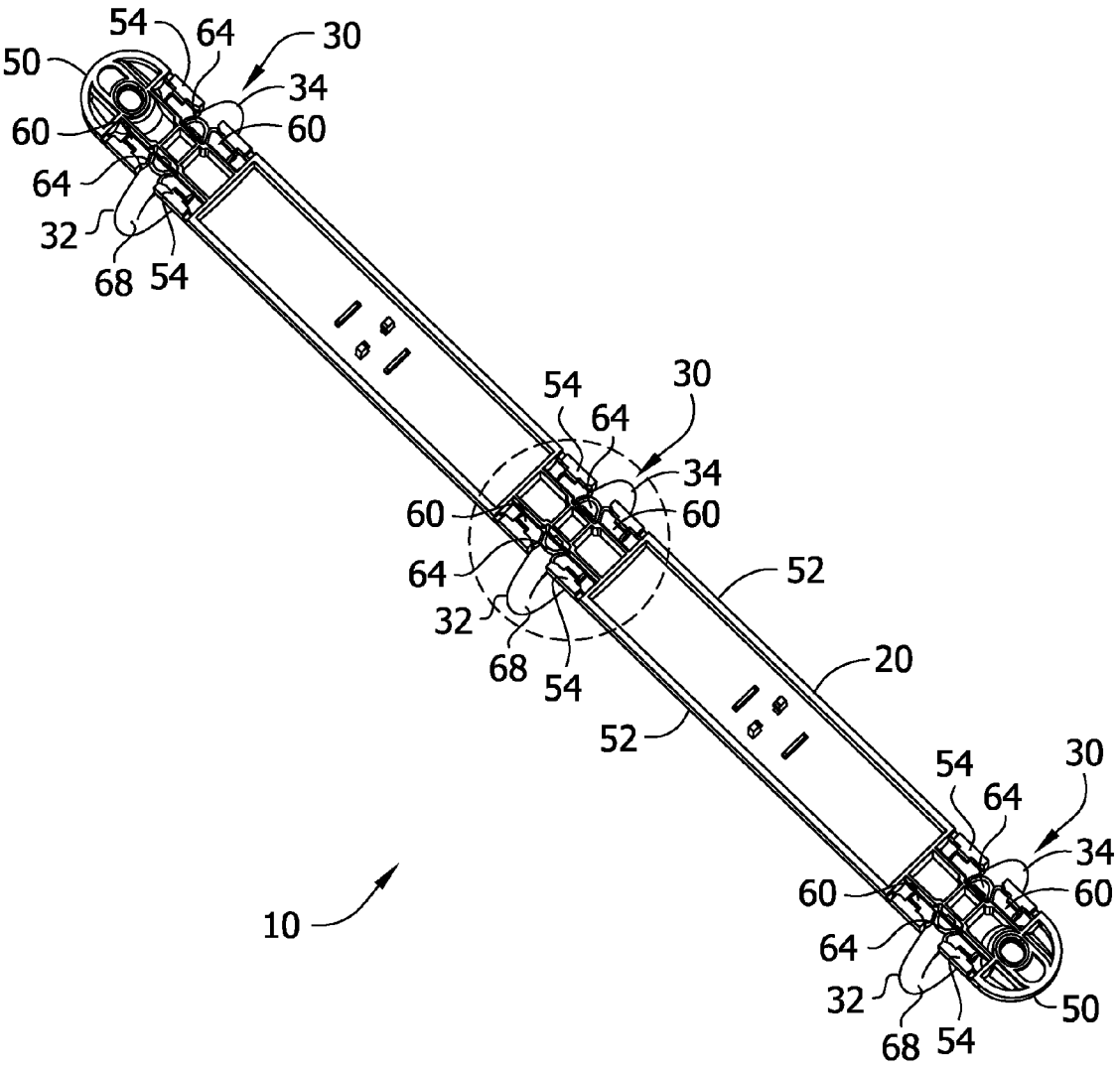
FIG. 3 is a bottom side perspective of the ring binder mechanism in the closed position.
Figure 3A:
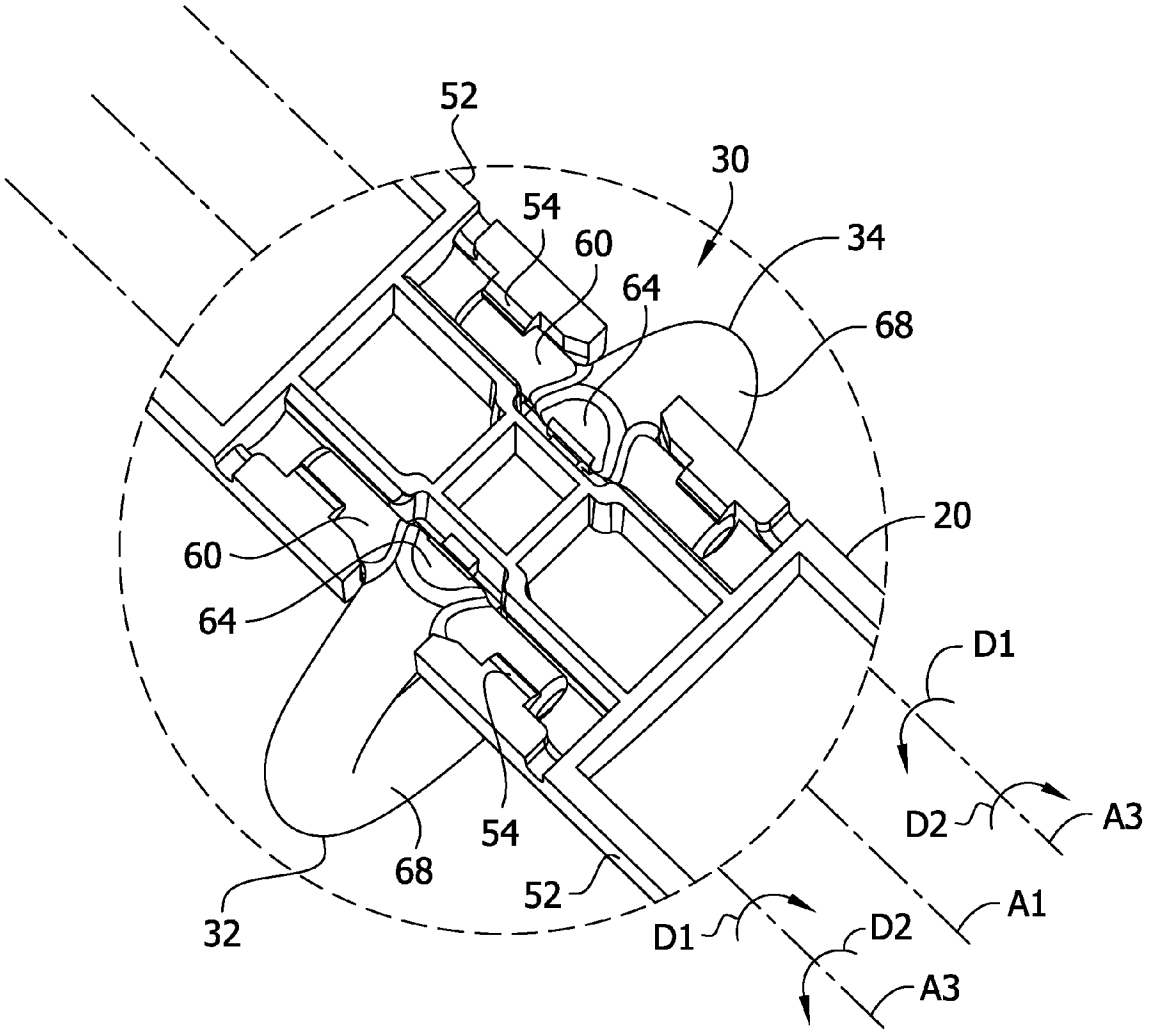
FIG. 3A is an enlarged view of a portion of FIG. 3.
Figure 4:
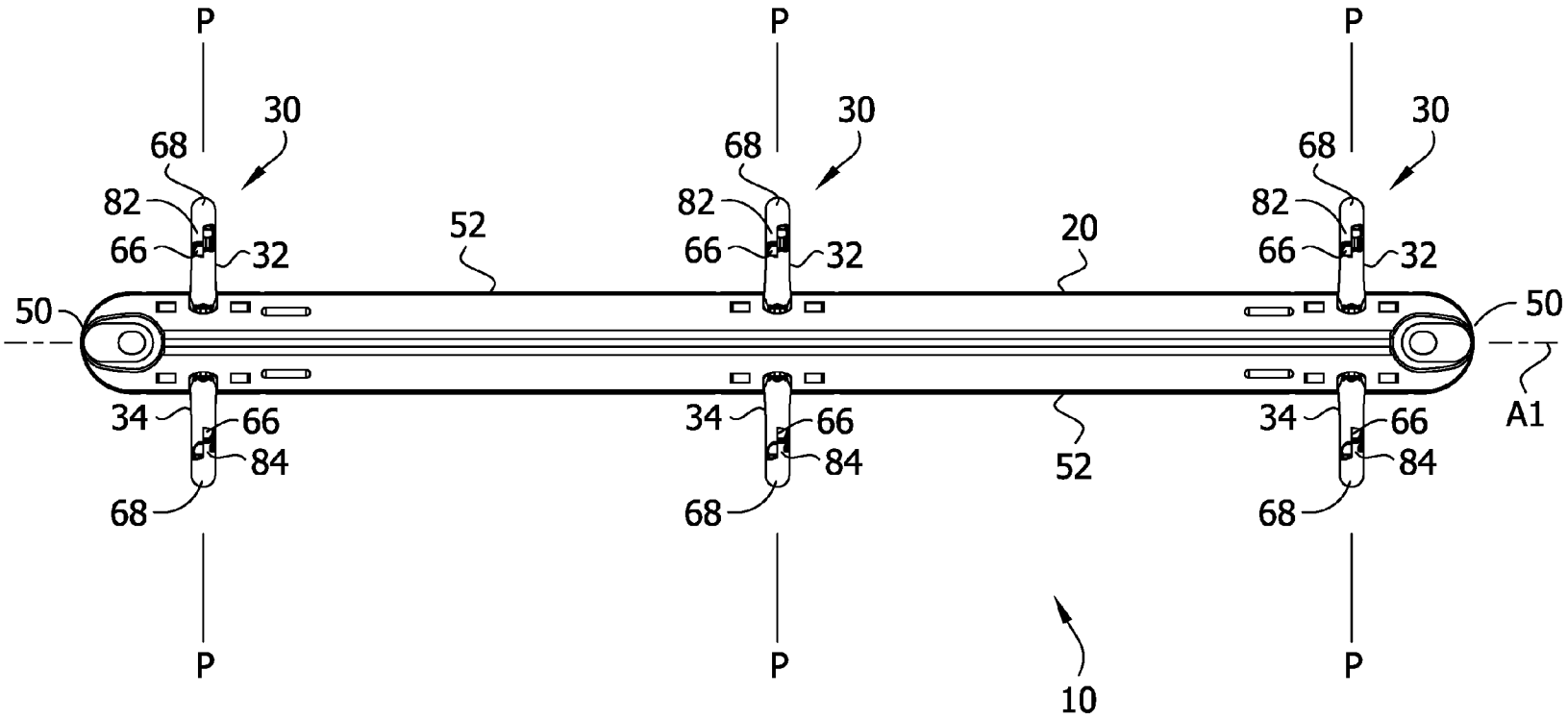
FIG. 4 is a top plan view of the ring binder mechanism in the open position.
Figure 5:
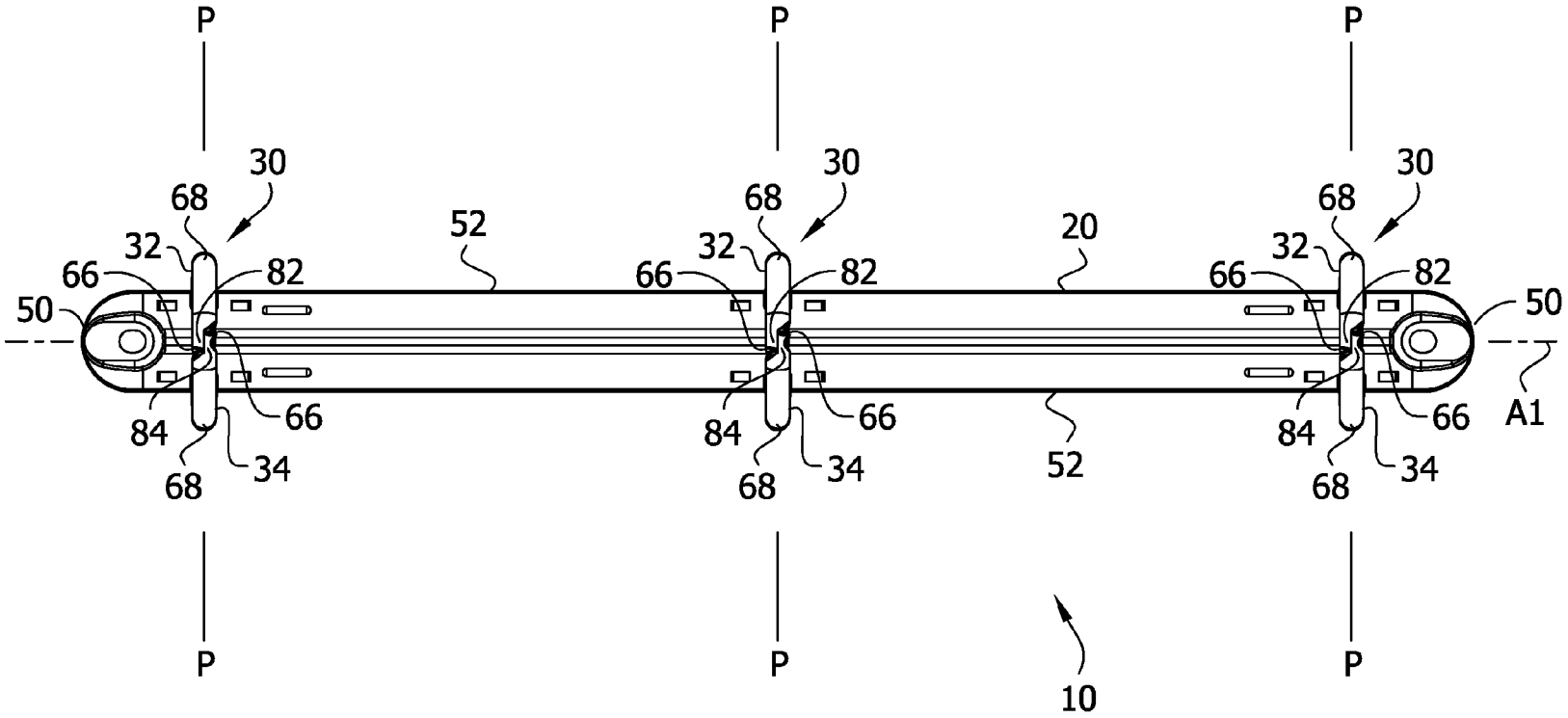
FIG. 5 is a top plan view of the ring binder mechanism in the closed position.
Figure 6:
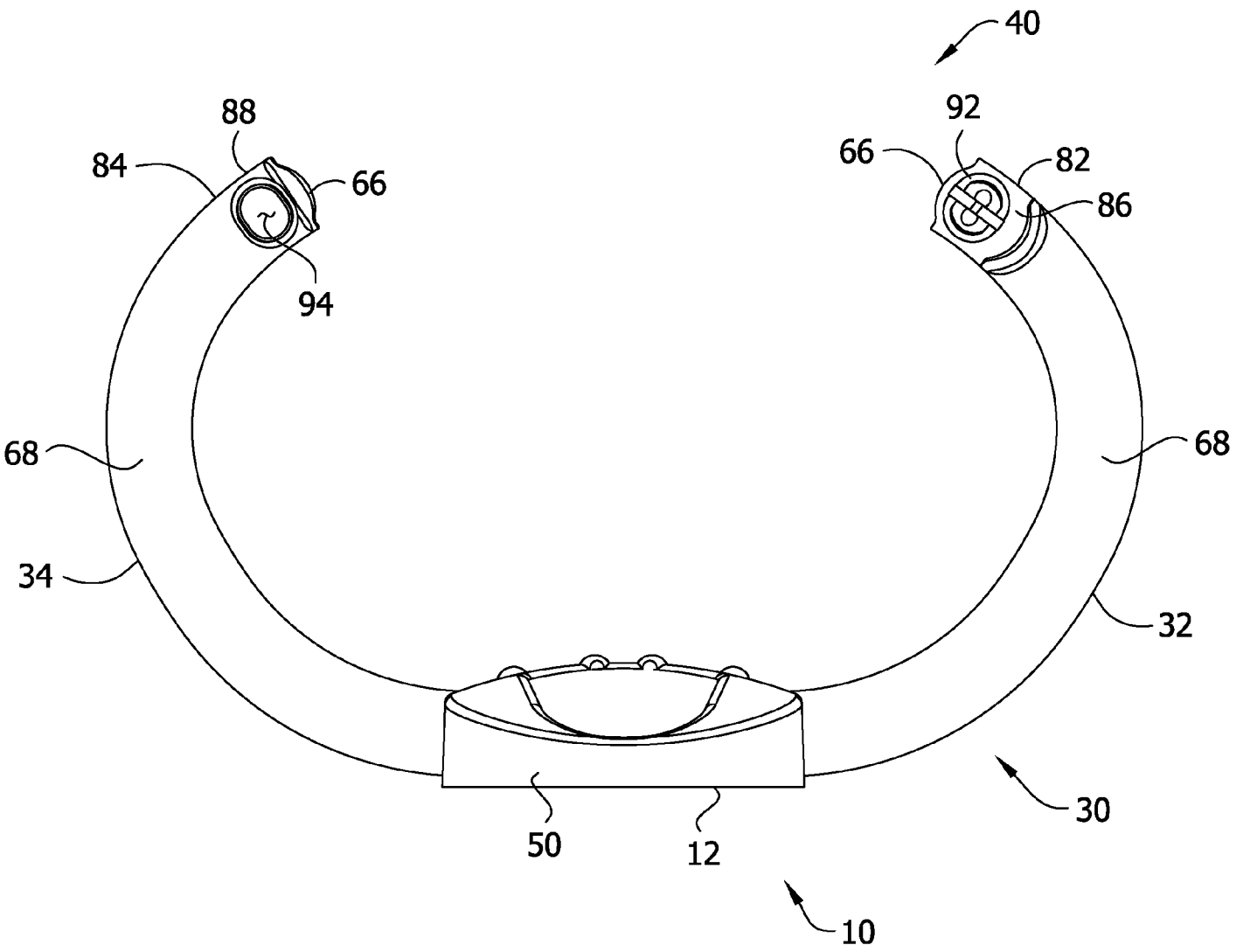
FIG. 6 is an elevation of the ring binder mechanism in the open position.
Figure 7:
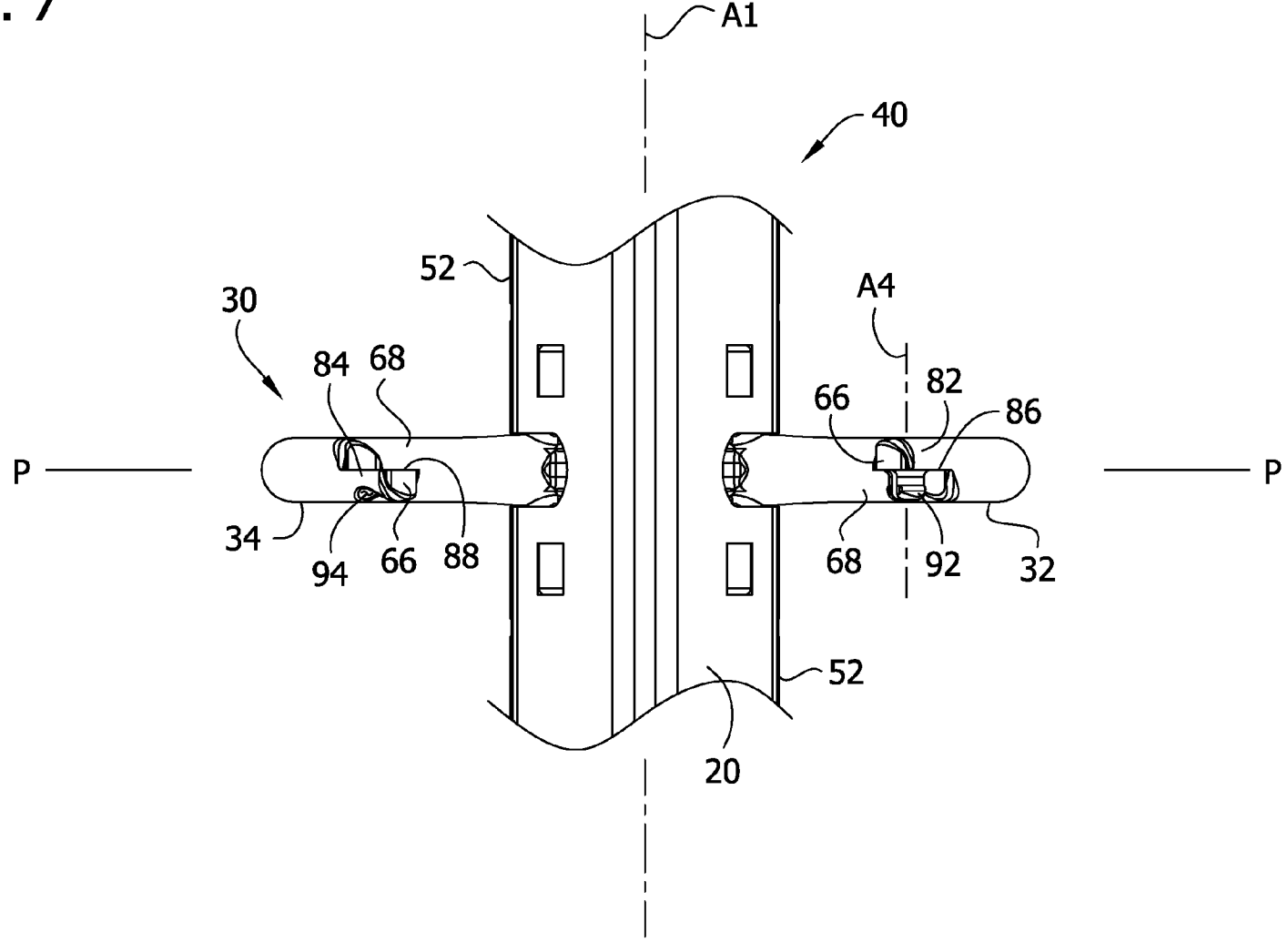
FIG. 7 is an enlarged, fragmentary top plan view of the ring binder mechanism in the open position.

With further reference to FIGS. 1 and 2, the base 20 extends lengthwise along a longitudinal axis A1 between opposite ends 50 and widthwise along a lateral axis A2 between opposite longitudinal sides 52. In the illustrated embodiment, the base 20 is a one piece body of molded plastic material. However, in other embodiments, the base can be made from different materials and have different constructions without departing from the scope of the invention. Referring to FIGS. 3 and 3A, the bottom of the base 20 includes three pairs of bearing members 54 spaced apart from each other along the length of the base. Each of the bearing members 54 defines an axially extending arcuate recess. As discussed in further detail below, each of the bearing members 54 is configured to receive a pivot shaft 60 of a respective one of the ring members 32, 34 in the arcuate recess to secure the ring member to the base. In addition, the bearing members 54 are configured to permit rotation of the pivot shaft 54 in the arcuate recess about its longitudinal axis.

Referring to FIGS. 1 through 5, each of the ring members 32, 34 is connected to and supported by the base 20 for pivoting movement relative the base between the open and closed positions. The ring members 32, 34 are each a one piece body of plastic material formed separately from one another and the base 20. However, it will be understood that the ring members can be made from different materials and have different constructions without departing from the scope of the invention. For example, it is contemplated that the ring members could be formed together with the base as an integrally formed, one piece body. Each ring member 32, 34 has a proximal end 64 that is connected to the base and an opposite distal end 66 that is a free end when the ring 30 is in the open position. In the illustrated embodiment, the pivot shaft 60 is located near the proximal end 64 of each ring member 32, 34.

A curved arm portion 68 extends between the proximal and distal ends of each of the ring members 32, 34. The curved arm portion 68 of each ring member 32, 34 has a substantially circular cross sectional shape. When the ring members 32, 34 are in the closed position, the curved arm portions 68 form a loop having a generally circular shape (FIG. 2). It is understood that ring members could form loops in the closed position having different shapes without departing from the scope of the invention. For each ring 30 in the closed and open positions, a loop plane P (FIGS. 4 and 5) bisects the arm portions 68 of the ring members 32, 34 as each extends distally from the respective pivot shaft 60 to the respective distal end 66. Thus, each of the rings 30 is understood to be oriented in a respective one of the loop planes P. In the illustrated embodiment the loop planes P are oriented substantially orthogonal to the longitudinal axis A1 of the base 20.

Referring again to FIGS. 3 and 3A, for each of the ring members 32, 34, the pivot shaft 60 extends axially from the proximal end of the respective curved arm portion 68 in opposite directions along a hinge axis A3 oriented parallel to the longitudinal axis A1 of the base 20 and transverse (preferably substantially orthogonal) to the loop plane P. Each pivot shaft 60 is received in the arcuate recess defined by the respective bearing member 54 on opposite sides of the curved arm portion 68. The pivot shaft 60 is received in the respective bearing member 54 for rotation about the respective hinge axis A3 therein in the opening direction D1 and the closing direction D2. Each of the ring members 32, 34 is, thus, hingedly connected to the base 20 for pivoting movement in the opening and closing directions D1, D2 relative to the base about the hinge axis A3. It will be understood that the ring members could be hingedly connected to the base for pivoting motion relative to the base in other ways without departing from the scope of the invention. For example, it is contemplated that the ring members could be integrally formed with the base and hingedly connected to the base at a living hinge for pivoting motion relative the base. Likewise, although both of the ring members 32, 34 are configured for pivoting movement relative the base 20, it is contemplated that only one of the ring members could be configured for pivoting movement relative the base while the other is fixed relative the base without departing from the scope of the invention.

The ring binder mechanism 10 does not bias the ring members 32, 34 toward either of the open or closed positions. Without the retaining system 40, the ring members 32, 34 would be substantially free to pivot in the opening direction D1 from the closed position. As discussed in greater detail below, the retaining system 40 secures the ring members 32, 34 in the closed position to prevent unintended opening of the rings 30 during use, particularly in response to forces urging movement of the ring members in the opening and closing directions D1, D2. Though ring members 32, 34 are not biased toward either of the open or closed positions, it is contemplated that the ring members could be biased toward the open and closed positions as is well known in the art without departing from the scope of the invention.

Figure 8:
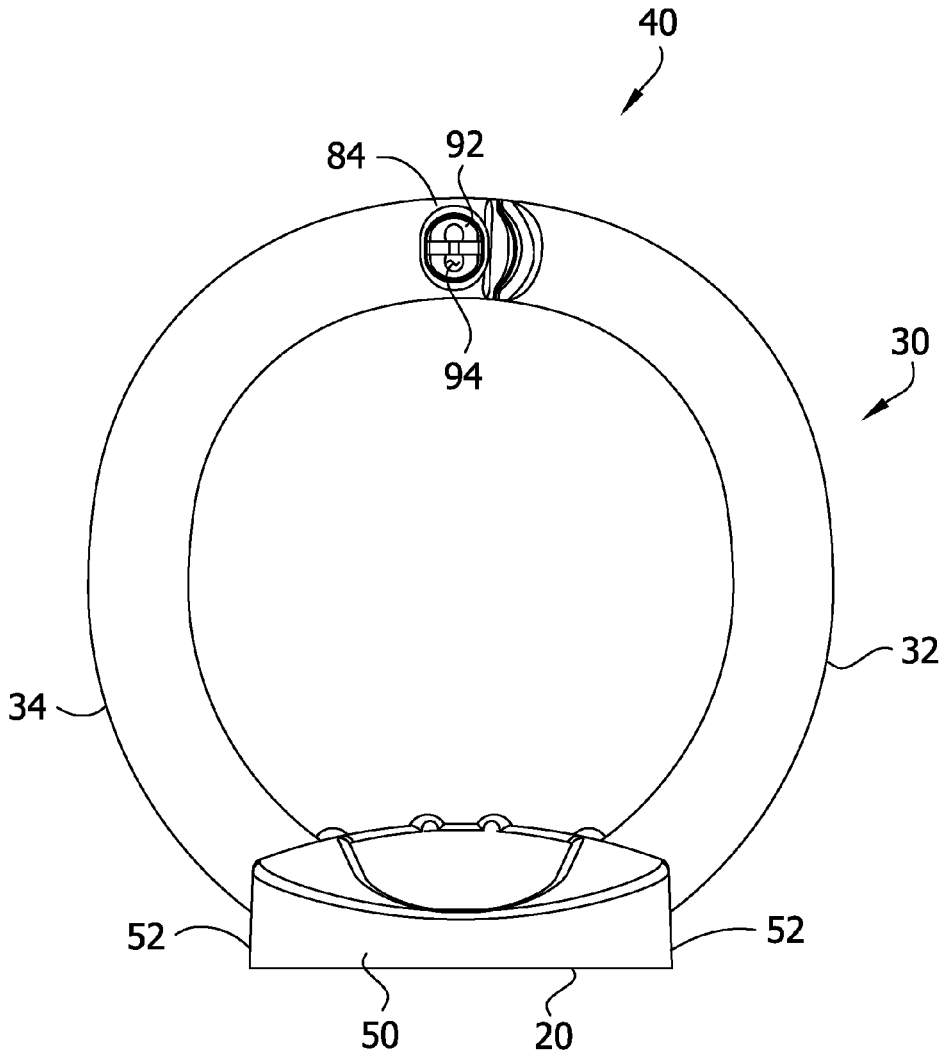
FIG. 8 is an elevation of the ring binder mechanism in the closed position.
Figure 9:
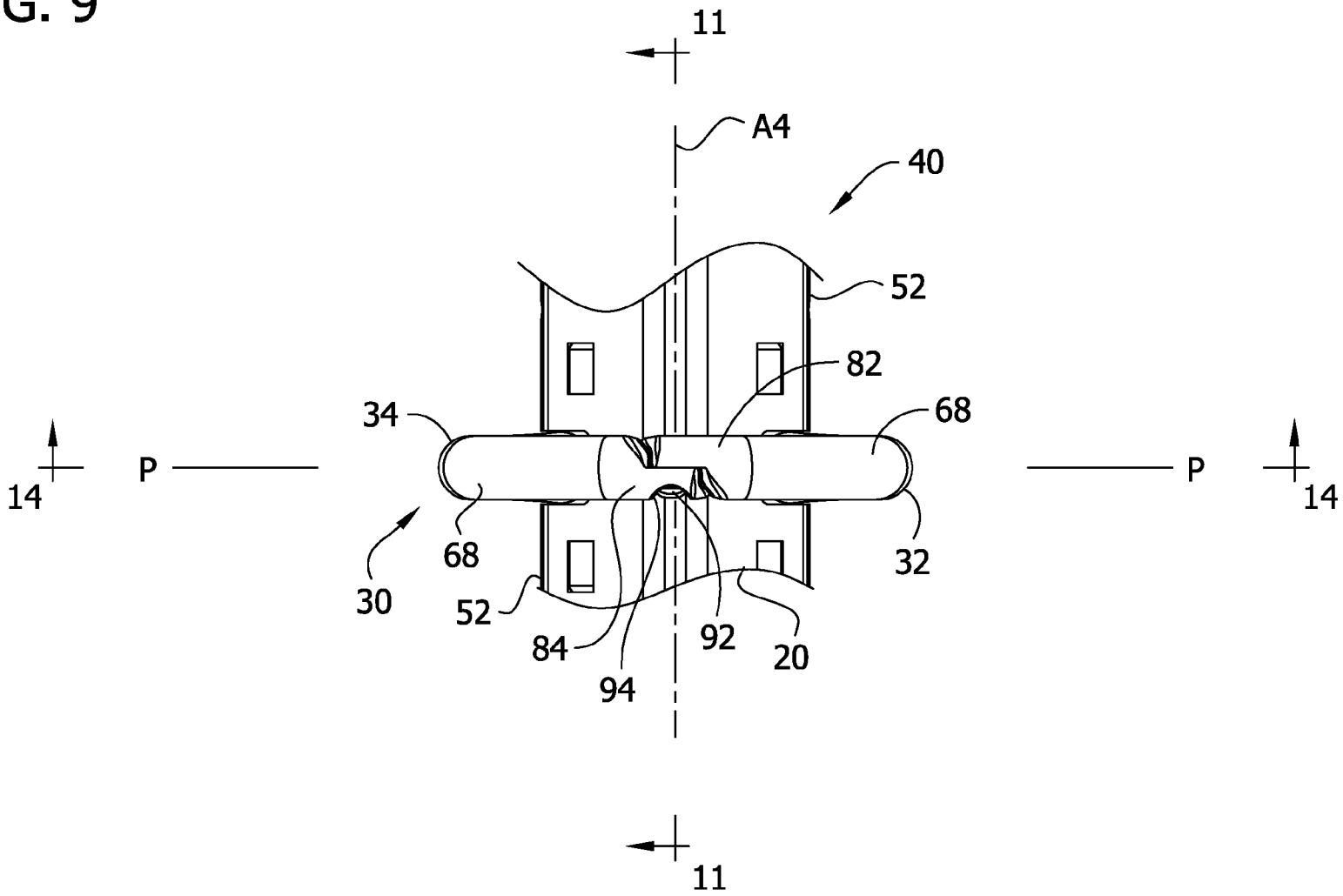
FIG. 9 is an enlarged, fragmentary top plan view of the ring binder mechanism in the closed position.

Referring to FIGS. 6-10, the retaining system 40 is operable to selectively and releasably hold the ring members 32, 34 in the closed position. The retaining system 40 includes a first interlocking portion 82 adjacent the distal end 66 of the first ring member 32 and a second interlocking portion 84 adjacent the distal end of the second ring member 34. The first interlocking portion 82 is located at a distal end portion of the first ring member 32 and extends proximally away from the distal end 66 of the first ring member generally parallel to the loop plane P. Likewise, the second interlocking portion 84 is a distal end portion of the second ring member 34 and extends proximally away from the distal end 66 of the second ring member generally parallel to the loop plane P. When the ring 30 is closed, first and second interlocking portions 82, 84 are substantially aligned in face-to-face relationship (FIGS. 8 and 9).

Figure 11:
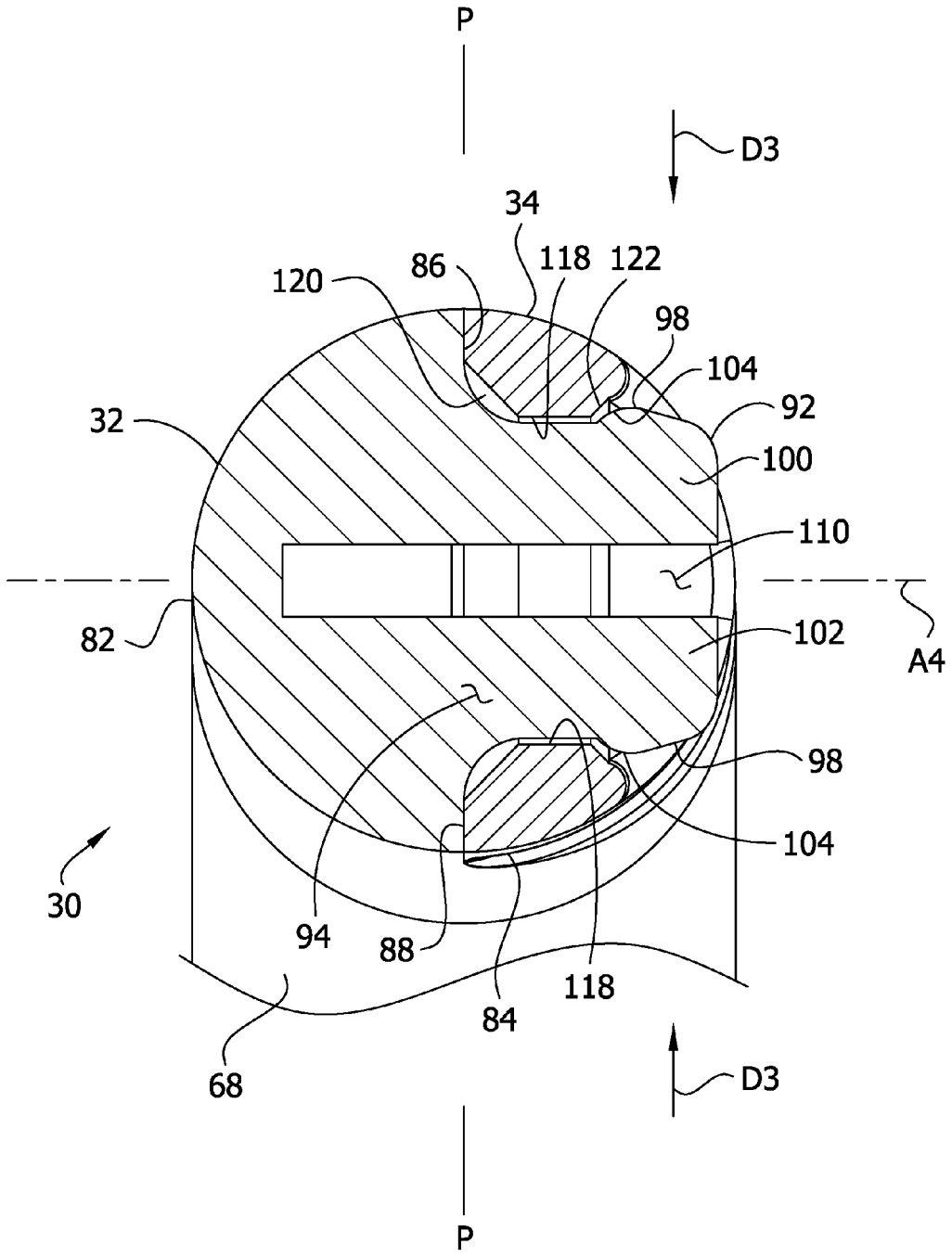
FIG. 11 is a section taken in the plane of 11-11 of FIG. 9.

When the ring 30 is closed, the interlocking portions 82, 84 of the first and second ring members 32, 34 overlap one another. As shown in FIG. 11, a substantially planar facing surface 86 of the first interlocking portion 82 is substantially flush with a substantially planar facing surface 88 of the second interlocking portion 84 when the ring members 32, 34 are closed. In a preferred embodiment, the substantially planar facing surfaces 86, 88 are oriented substantially parallel to the loop plane P and are positioned adjacent thereto when the ring members 32, 34 are closed.

Referring to FIGS. 6-11, the first and second interlocking portions 82, 84 of the first and second ring members 32, 34 include first and second interlocking formations 92, 94, respectively. The first interlocking formation 92 is located adjacent the distal end 66 of the first ring member 32, and the second interlocking formation 94 is located adjacent the distal end of the second ring member 34. The first interlocking formation 92 is operable to engage the second interlocking formation 94 such that the formations limit the relative movement of the interlocking portions 82, 84 of the ring members 32, 34 away from the closed position. As discussed in greater detail below, the ring members 32, 34 are selectively movable from a non-retaining position in which the retaining system 40 does not hold the ring members 32, 34 in the closed position to a retaining position in which the first interlocking formation 92 engages the second interlocking formation 94 to hold the ring members in the closed position. Moreover, in the retaining position, the first and second interlocking formations 92, 94 are configured for particularly strong interlocking engagement against the pivoting movement of the ring members 32, 34 in the opening and closing directions D1, D2.

Figure 10:
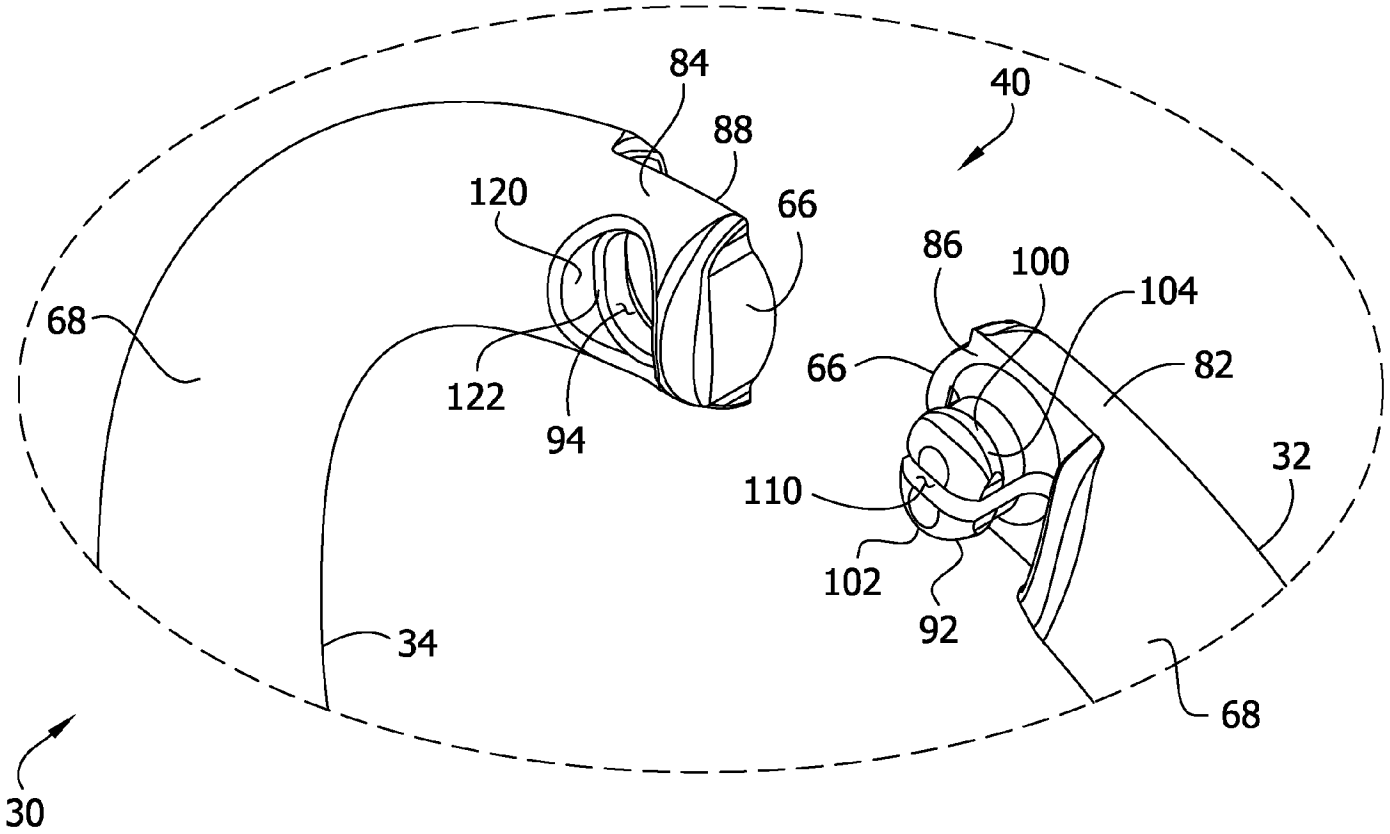
FIG. 10 is an enlarged fragmentary perspective of the ring binder in a position between the open and closed positions.
Figure 12:
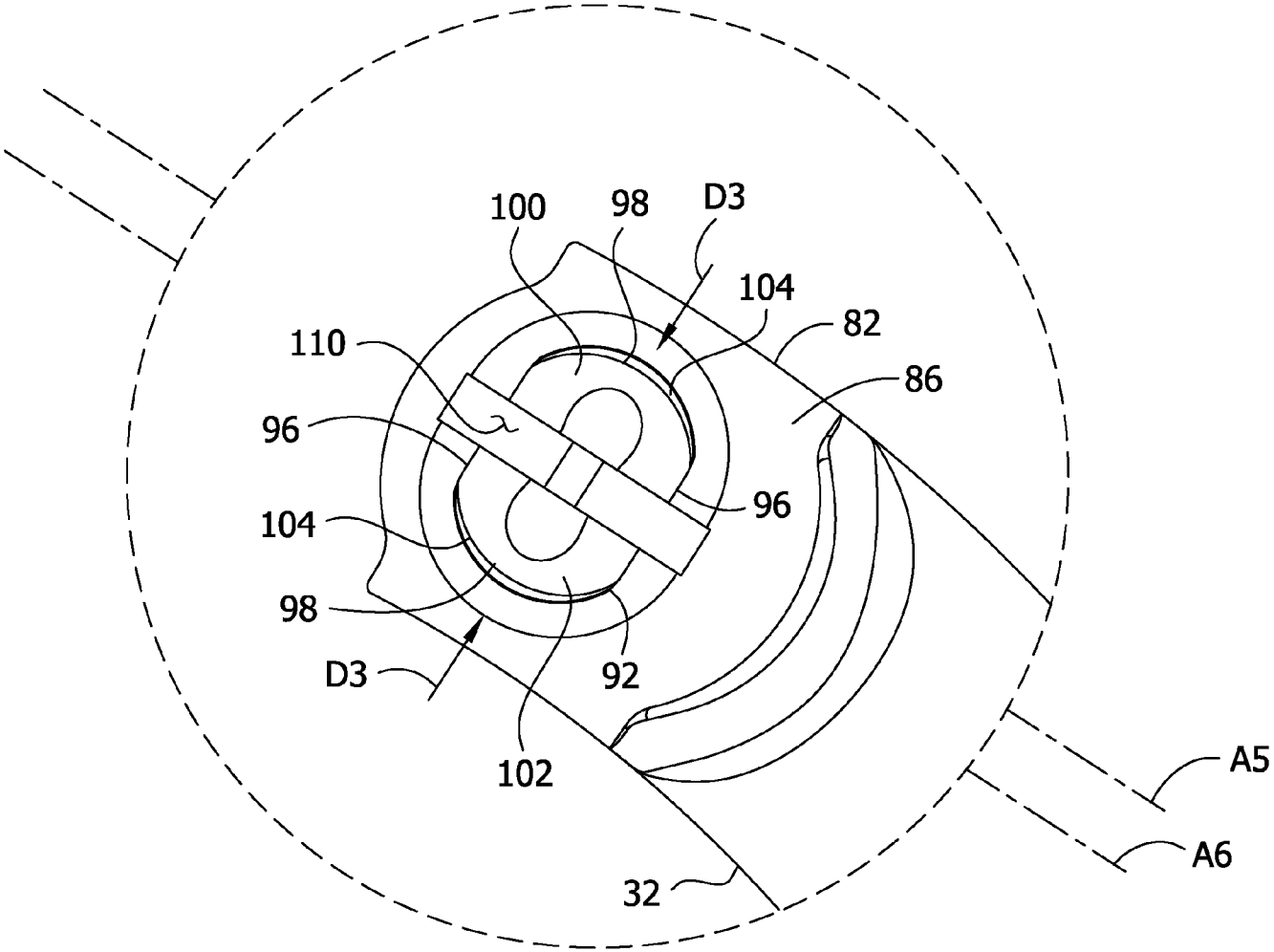
FIG. 12 is an enlarged, fragmentary elevation of an interlocking portion of the ring binder mechanism.

Referring to FIGS. 10-12, the first interlocking formation 92 includes a projection extending along a projection axis A4 from the facing surface 86 of the first interlocking portion 82. The projection axis A4 is oriented generally parallel to the longitudinal axis A1 of the base 20 and generally orthogonal to the loop plane P. The second interlocking formation 94 includes an opening extending axially through the second interlocking portion 84 of the second ring member 34 in a direction parallel to the longitudinal axis A1 of the base 20 and orthogonal to the loop plane P. The opening 94 is operable to releasably capture the projection 92 when the projection is inserted into the opening.

The projection 92 includes radially spaced apart top and bottom fingers 100, 102 that collectively form an axially extending post. Each finger 100, 102 has opposite lateral sides 96, which are respectively spaced apart from one another along an axis oriented generally parallel to the lateral axis A2 in the closed position. The radially outward surface of each finger 100, 102 also defines a radial end 98 of the projection 92. The radial ends 98 of the projection 92 are vertically spaced apart from one another (i.e., along an axis that extends transverse to the longitudinal and lateral axes A1, A2) in the closed position. When the ring 30 is closed, the top finger 100 is positioned above the bottom finger 102 relative the base 20 (i.e., the top finger 100 is spaced apart from the base 20 a greater distance than the bottom finger 102). The first and second fingers 100, 102 define the entire radial extent of the free end of the projection 92. The two fingers 100, 102 are connected at their bases to the first interlocking portion 82 of the first ring member 32 and remain separate from one another along the entire axial extent of the projection 92. The fingers could also be separate from one another at the free end of the projection and together at the base of the projection without departing from the scope of the invention.

Each of the fingers 100, 102 has an arcuate radially outer surface and a substantially planar radially inner surface that extend axially between the base and free end of the finger. When the ring 30 is closed, the substantially planar radially inner surface of each of the fingers 100, 102 is positioned in a respective plane oriented generally parallel to by the longitudinal axis A1 and lateral axis A2 of the base 20. The radially outer surface of each of the fingers 100, 102 forms a radially outwardly extending lip 104 at the free end of the respective finger. As discussed in greater detail below, the lip 104 is configured to engage an opposed surface of the second interlocking portion 84 when the ring members 32, 34 are closed to inhibit the projection 92 from sliding out of the opening 94 in response to forces causing the first interlocking portion 82 to move away from the second interlocking portion in a direction parallel to the projection axis A4.

A single elongate slot 110 (broadly, a void) of generally rectilinear cross-sectional shape is formed in the free end of the projection 92. The slot 110 is configured and arranged to permit resilient bending of the free ends of the fingers 100, 102 radially inwardly in a bending direction D3 along bending axes A5, A6 into the slot. The bending direction D3 is a vertical direction oriented transverse to the longitudinal and lateral axes A1 and A2 in the closed position. The bending axis A5, A6 of each finger 100, 102 is generally parallel to the lateral axis A2 of the elongate base 20 in the retaining position. Moreover, the slot 110 is configured and arranged relative the fingers 100, 102 to substantially inhibit the fingers from bending in a direction transverse to the bending direction D3 when the ring members 32, 34 pivot in the opening and closing directions D1, D2 from the retaining position. As explained below, in the retaining position, the retaining system 40 thus provides robust interlocking engagement against the pivoting movement of the ring members 32, 34 in the opening and closing directions D1, D2.

The slot 110 extends laterally through the projection from one side 96 to the other. The slot 110 also extends axially through the projection 92 from the free end through the entire axial extent of the projection and further into the first interlocking portion 92 (see FIG. 11). However, in other embodiments the slot can extend through a portion of the lateral or axial extents of the projection without departing from the scope of the invention. The slot 110 has opposite longitudinal sides that are bounded by the radially inward surfaces of the first and second fingers 100, 102. The longitudinal sides of the slot 110 extend transverse to the projection axis A4 and between the opposite longitudinal sides 52 of the base 20 when the ring 30 is closed. In the illustrated embodiment, the longitudinal sides of the slot 100 extend generally perpendicular to the projection axis A4. In the closed position, the longitudinal sides of the slot 110 are oriented generally parallel to the lateral axis A2 of the base 20.

Figure 13:
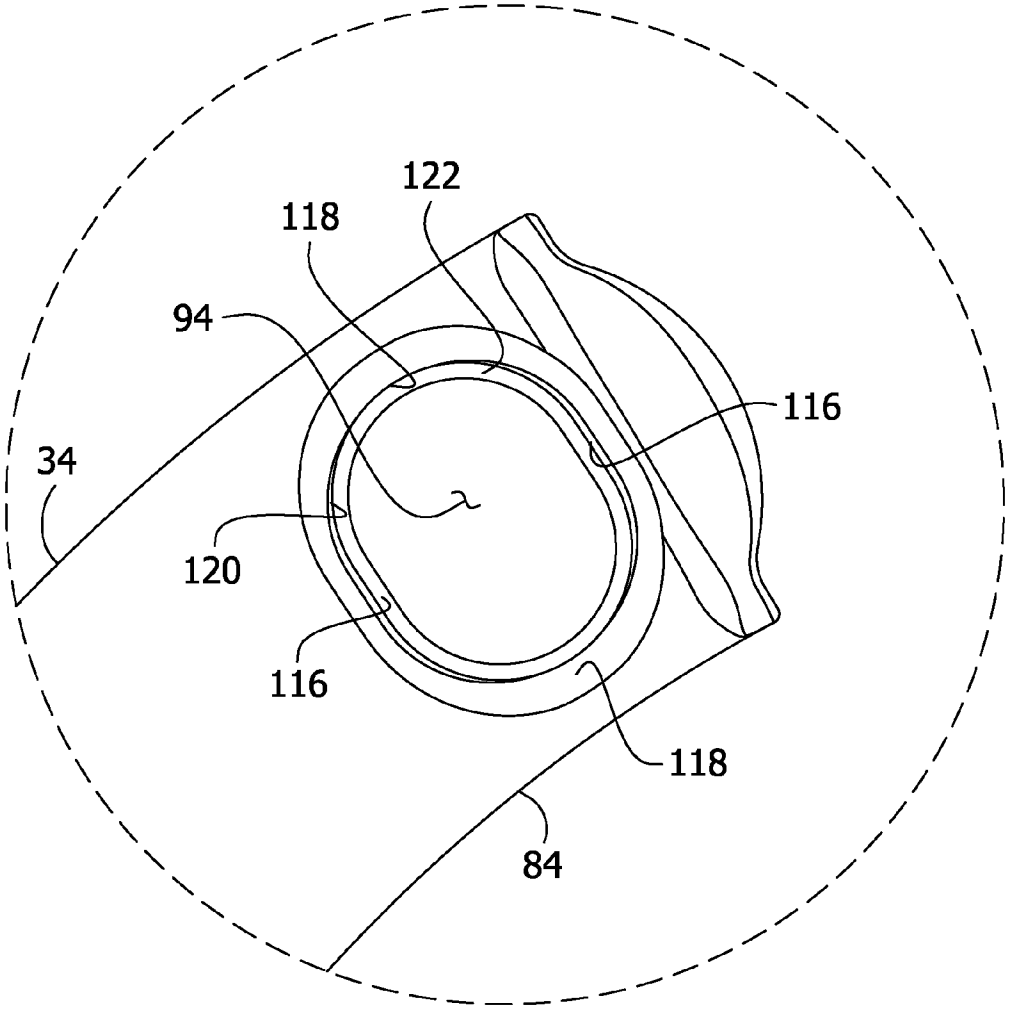
FIG. 13 is an enlarged, fragmentary elevation of another interlocking portion of the ring binder mechanism.

As shown for example in FIG. 13, the opening 94 has a slightly elongate cross-sectional shape corresponding to the shape of the projection 92. Opposite sides 116 of the opening 94 are spaced apart from one another and oriented vertically (i.e., transverse to the longitudinal and lateral axes A1, A2) in the closed position. Top and bottom radial ends 118 of the opening are vertically spaced apart from one another in the closed position. The opening 94 is suitably sized to compress the projection 92 radially inward in the bending direction D3 as the projection is inserted into the opening (i.e., moves from a non-retaining position to the retaining position).

Figure 14:
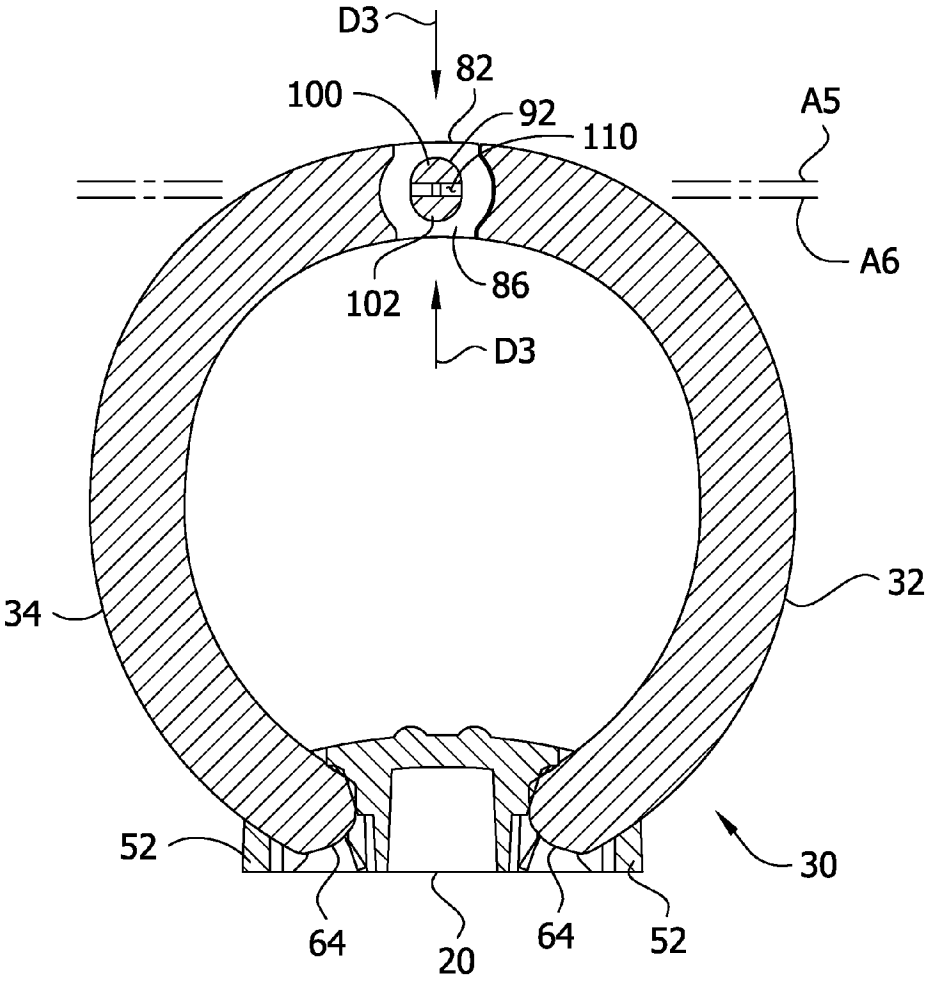
FIG. 14 is a section taken in the plane of 14-14 of FIG. 9.

Referring further to FIG. 13, the opening 94 is bounded by an axially extending wall 120 of the second interlocking portion 84. The wall 120 includes a radially inwardly extending lip 122 configured and arranged to engage the radially outwardly extending lips 104 of the upper and lower fingers 100, 102 when the ring members 32, 34 are in the closed position. The lip 122 of the opening 94 extends radially inward of the lips 104 of the projection 92. As the projection 92 is inserted into the opening 94, the wall 120 is configured to engage the free ends of the fingers 100, 102 and bend the fingers radially inwardly about the bending axes A5, A6 until the lips 104 are positioned radially inward of the lip 122. After the lips 104 pass over the lip 122, the fingers resiliently return (i.e., snap) radially outwardly to hold the ring members 32, 34 in the closed position. Referring to FIGS. 11 and 14, when the ring members 32, 34 are in the retaining position, the wall 120 engages the radial ends 98 and sides 96 of the projection 92. The lips 104 of the projection 92 engage the lips 122 of the opening to inhibit unintentional disengagement when the ring members 32, 34 move away from one another in a direction parallel to the projection axis A4.

In the retaining position, the fingers 100, 102 are arranged relative the slot 110 to substantially inhibit bending in a direction transverse to the bending direction D3 (i.e., along an axis oriented transverse to the bending axes A5, A6) in response to the pivoting movement of either of the ring members 32, 34 in the opening and closing directions D1, D2. Furthermore, the projection 92 is configured to resist bending of any portion thereof in a direction substantially parallel to a direction in which the projection is urged to travel in response to forces tending to cause pivoting movement of the first and second ring members 30, 32 in the opening and closing directions D1, D2. The fingers 100, 102 substantially fill end portions of the opening 94 adjacent the radial ends 118 thereof. The fingers 100, 102 each extend laterally across the opening from one of the sides 116 to the other and have no voids formed between their opposite sides 96. As a result, the fingers 100, 102 are each a solid piece of material that is substantially inhibited from bending toward or away from the sides 116 of the opening 94 in response to relative movement of the first and second interlocking portions 82, 84 in a direction transverse to the bending direction D3. By comparison, the slot 110 forms a void in the projection 92 that separates the fingers 100, 102 between the radial ends 118 of the opening 94. The fingers 100, 102 are, therefore, substantially free to resiliently bend radially inward into the slot 110 along the bending axes A5, A6 and substantially inhibited from bending along axes oriented transverse to the bending axes.

In the retaining position, attempts to pivot the ring members 32, 34 in the opening and closing directions D1, D2 causes the first and second interlocking portions 82, 84 to try to move relative one another in a direction generally parallel to the lateral axis A2 and in the loop plane P. When either of the ring members 32, 34 tries to pivot in the opening or closing direction D1, D2, a side wall 96 of the projection 92 engages a side wall 116 of the opening 94. However, since the fingers 100, 102 fill the distal ends 118 of the opening 94 from one side 116 to the other, they do not bend radially inward toward or away from either side in response to the engagement with the sidewalls. Accordingly, the projection 92 and opening 94 are arranged and configured to substantially inhibit movement relative one another in response to attempts to pivot either of the ring members 32, 34 in the opening and closing directions D1, D2.

Figure 15:
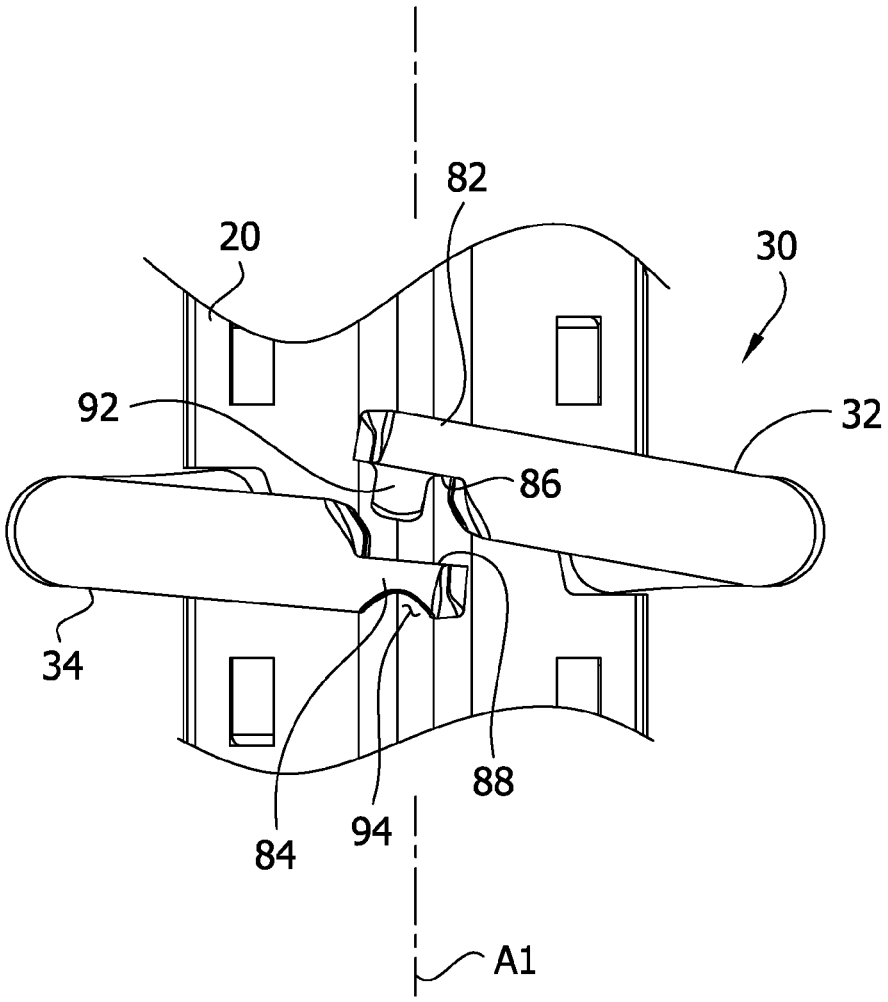
FIG. 15 is an enlarged, fragmentary top plan view of the ring binder mechanism in a closed, but non-retaining position.

As shown in FIG. 15, in an exemplary method of closing the rings 30 of the binder mechanism 10, the ring members 32, 34 are moved to an overlapping position so that the projection 92 is aligned with the opening 94. From the open position, the ring members 32, 34 pivot toward one another in the closing direction D2 and move away from one another in a direction generally parallel to the longitudinal axis A1 of the base 20. As illustrated in FIG. 15, the ring members are in a non-retaining position in which the retaining system 40 does not hold the ring members 32, 34 in the closed position. To insert the projection 92 into the opening 94, the interlocking portions 82, 84 are moved toward each other in a direction generally parallel to the longitudinal axis A1 of the base 20 (and also parallel to the projection axis A4). When the facing surfaces 86, 88 of the interlocking portions 82, 84 are positioned substantially flush with one another as shown in FIGS. 8-9, 11, and 14, the interlocking formations 92, 94 are in a retaining position in which the retaining system 40 holds the first and second ring members 32, 34 in the closed position.

As the ring members 32, 34 move from the non-retaining position to the retaining position, the radial ends 98 of the free end of the projection 92 engage the wall 120 defining the opening 94. The radial ends 118 of the opening 117 engage the radial ends 98 of the free ends of the fingers 100, 102 and apply a radially inwardly oriented force on the fingers in a direction parallel to the bending direction D3. As the interlocking portions 82, 84 are moved from the non-retaining position to the retaining position, the fingers 100, 102 resiliently bend radially inwardly toward the slot 110 in the bending direction D3. The fingers 100, 102 bend radially inwardly until the lips 104 are positioned radially inwardly of the lip 122. As the projection 92 is inserted further into the opening 94, the fingers 100, 102 resiliently return radially outwardly until the ring members 32, 34 reach the retaining position.

The arrangement of the fingers 100, 102 and the slot 110 substantially inhibits bending about an axis oriented transverse to the bending axes A5, A6 as the ring members 32, 34 move from the non-retaining position to the retaining position. As the ring members 32, 34 move from the non-retaining position to the retaining position, both sides 96 of the fingers 100, 102 engage the sides 116 of the opening 94. Since no voids are formed in the fingers 100, 102 between the opposite sides 96 thereof, the fingers do not bend inwardly in response to the engagement with the sides 116 of the opening. Moreover, since the fingers 100, 102 are sized to simultaneously engage both sides 116 of the opening 94 as they are inserted into it, they cannot bend side to side in a direction generally parallel to the lateral axis A2 within the opening.

In the retaining position, the projection 92 extends axially into the opening 94 so that the radial sides and ends 96, 98 engage the opening wall 120 to inhibit movement of the projection 92 relative the opening 94. The radially inwardly extending lip 122 of the opening wall 120 engages the radially outwardly extending lips 104 of the fingers 100, 102 to resist movement of the first interlocking portion 82 away from the second interlocking portion 84 in a direction parallel to the projection axis A4. In addition, the fingers 100, 102 substantially fill the radial ends 118 of the opening 94 from one side 116 to the other. Though the fingers 100, 102 are relatively free to bend radially inwardly into the slot 110 in the bending direction D3, the fingers are substantially inhibited from bending in the loop plane P in a direction transverse to the bending direction. Moreover, as discussed above, in the retaining position, the fingers 100, 102 are substantially inhibited from bending in response to the pivoting movement of the ring members 32, 34 in the opening and closing directions D1, D2.

To open the rings 30, the ring members 32, 34 are moved away from one another in a direction generally parallel to the longitudinal axis A1 of the base 20 (and parallel to the projection axis A4) to remove the projection 92 from the opening 94. As the projection 92 is removed from the opening 94, the radial ends 98 of the projection 92 engage the wall 120 defining the opening and apply a radially inwardly oriented force on the fingers 100, 102. The fingers 100, 102 resiliently bend inward about their bending axes A5, A6 in response to the engagement until the radially outwardly extending lips 104 are disposed radially inwardly of the radially inwardly extending lip 122. The radially outwardly extending lips 104 pass over the radially inwardly extending lip 104 and the projection 92 is removed from the opening 94. Subsequently, the ring members 32, 34 can be pivoted in the opening direction D2 until they reach the open position.

It is preferable for a ring binder mechanism to have a retaining system that securely holds the rings in the closed position. In the illustrated embodiment, the ring members 32, 34 close by pivoting in the closing direction D2 and moving parallel to the projection axis A4 in an insertion direction. Accordingly, it is preferable for the retaining system 40 to substantially inhibit the ring members 32 34 from unintended movements in directions opposite the closing direction D2 and insertion direction. The retaining system 40 provides interlocking lips 104, 122 on the projection 92 and opening 94, respectively, to inhibit movement of the ring members in a direction opposite the insertion direction. However, the interlocking lips 104 of the projection 92 extend radially outwardly beyond the radially inward end of the lips 122 of the opening 94. Accordingly, to enable insertion of the projection 92 into the opening 94, the lips 104, 122 must be radially deformable relative one another. Because the ring members 32, 34 are designed to pivot in the opening and closing directions D1, D2, it is preferable to enable the necessary deformation without adversely affecting the interlocking engagement provided by the retaining system 40 against the pivoting movement of the ring members. The illustrated retaining system 40 achieves the necessary radial deformation of the projection 92 relative the opening 94 without adversely affecting the strength of the interlocking engagement for inhibiting the pivoting movement of the ring members 32, 34 by arranging the slot 110 relative the fingers 100, 102 so that the fingers bend radially inwardly in the bending direction D3 and are substantially inhibited from bending in a direction transverse to the bending direction.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above apparatuses, systems, and methods without departing from the scope of the invention, it is intended that all matter contained in the above description and shown in the accompanying drawings shall be interpreted as illustrative and not in a limiting sense.

What is claimed is:

1. A ring binder for use in holding loose-leaf pages, the ring binder comprising:

an elongate base;

rings for retaining loose leaf pages, each ring including first and second ring members movable relative to one another between a closed position in which the first and second ring members together form a substantially continuous closed loop and an open position in which the first and second ring members form a discontinuous open loop, at least one of the first and second ring members being hingedly connected to the elongate base for selective pivoting movement toward the open and closed positions; and a retaining system configured to selectively and releasably hold the first and second ring members in the closed position, the retaining system comprising first and second interlocking formations adjacent ends of the first and second ring members, respectively, the first and second interlocking formations being selectively movable relative to one another between a retaining position in which the retaining system holds the first and second ring members in the closed position and a non-retaining position in which the retaining system does not hold the first and second ring members in the closed position, the first interlocking formation comprising a projection having a free end, the free end having a void configured and arranged to permit resilient bending of portions of the free end of the projection in a first direction as they engage the second interlocking formation when the interlocking formations are moved from the non-retaining position to the retaining position, wherein said portions of the free end of the projection are arranged relative the void so that in the retaining position said portions are substantially inhibited from bending in a second direction in response to the pivoting movement of said at least one of the ring members.

2. A ring binder as set forth in claim 1 wherein the second direction is transverse to the first direction.

3. A ring binder as set forth in claim 1 wherein the second direction is substantially parallel to a direction in which the projection travels during the pivoting movement of the first ring member from the closed position toward the open position.

4. A ring binder as set forth in claim 1 wherein the projection comprises first and second fingers and the void comprises an elongate slot formed between the first and second fingers.

5. A ring binder as set forth in claim 4 wherein the fingers are arranged relative the slot to resiliently bend radially inward in the first direction toward the slot as the interlocking formations are moved from the non-retaining position to the retaining position.

6. A ring binder as set forth in claim 4 wherein the fingers are arranged relative the slot to substantially inhibit bending in the second direction.

7. A ring binder as set forth in claim 1 wherein the pivoting movement causes the first and second interlocking portions to move relative one another in a direction generally parallel to the second direction and transverse to the first direction.

8. A ring binder as set forth in claim 1 in combination with a notebook, the ring binder being mounted on the notebook.

9. A ring binder for use in holding loose-leaf pages, the ring binder comprising:

an elongate base having a length and opposite longitudinal sides; and rings for retaining loose leaf pages, each ring including first and second ring members movable between a closed position in which the first and second ring members form a continuous closed loop and an open position in which the first and second ring members form a discontinuous open loop, each ring member including a proximal end connected to the base and an opposite distal end, the first ring member comprising a first interlocking portion adjacent the distal end thereof and the second ring member comprising a second interlocking portion adjacent the distal end thereof;

the first interlocking portion comprising a first interlocking formation and the second interlocking portion comprising a second interlocking formation, the interlocking formations being configured to selectively and releasably engage one another for holding the ring members in the closed position, the interlocking formations being selectively movable relative to one another between a retaining position in which the interlocking formations engage one another to hold the first and second ring members in the closed position and a non-retaining position in which the interlocking formations do not engage one another to hold the first and second ring members in the closed position, the first interlocking formation comprising a projection extending along an axis generally lengthwise of the elongate base and having a free end, the free end of the projection comprising a single elongate slot having opposite sides and extending transverse to the axis of the projection and between the opposite longitudinal sides of the elongate base in the retaining position, the projection comprising a finger adjacent each of the opposite sides of the elongate slot, the fingers being adapted to engage the second interlocking formation and resiliently bend inward toward the slot as the interlocking formations are moved from the non-retaining position to the retaining position and configured to resist bending in a transverse direction between the opposite longitudinal sides of the elongate base in the retaining position.

10. A ring binder mechanism as set forth in claim 9 wherein each of the fingers is formed as a single, solid piece of material.

11. A ring binder mechanism as set forth in claim 9 wherein the fingers are free of internal voids.

12. A ring binder mechanism as set forth in claim 9 wherein a first one of the fingers is spaced apart from the elongate base a greater distance than the second one of the fingers in the retaining position.

13. A ring binder mechanism as set forth in claim 9 wherein the second interlocking formation comprises an opening in the second interlocking portion, the opening having in the closed position opposite sides, a top, and a bottom and being sized to releasably capture the projection in the retaining position.

14. A ring binder mechanism as set forth in claim 13 wherein the fingers are substantially inhibited from bending toward either of the opposite sides of the opening in the retaining position.

* * * * *